United States Patent [19]

Matsuo et al.

[11] 4,371,332

[45] Feb. 1, 1983

[54] METHOD OF CONTROLLING THE TENSION OF A STRIP WITHIN FURNACE

[75] Inventors: Motoyuki Matsuo, Akashi; Haruo Komoto; Yoshihisa Mita, both of Kobe, all of Japan

[73] Assignee: Mitsubishi Denki Kabushiki Kaisha, Tokyo, Japan

[21] Appl. No.: 274,052

[22] Filed: Jun. 15, 1981

[30] Foreign Application Priority Data

Jun. 19, 1980 [JP] Japan ..... 55-84824

[51] Int. Cl.[3] ..... F27B 9/28; F26B 13/00; C21D 9/52

[52] U.S. Cl. ..... 432/1; 266/102; 432/8; 432/59

[58] Field of Search ..... 432/1, 8, 59; 266/102, 266/103

[56] References Cited

U.S. PATENT DOCUMENTS 2,278,136 3/1942 Otis et al. ..... 432/59

*Primary Examiner*—John J. Camby

*Attorney, Agent, or Firm*—Wenderoth, Lind & Ponack

[57] ABSTRACT

A method of controlling the tension of a strip carried by a multitude of rollers disposed in four section of a furnace and driven by electric sources, one source for each section through respectives electric motors. The actual difference in tension of the strip between the inlet and outlet of each section is compared with a corresponding reference difference tension stored in a tension profile control circuit to form a tension deviation. An allotment-of-tension scheduling circuit successively receives all of actual tensions and sets a tension to each section and a correction factor. After having been amplified by the correction factor in one multiplier for each section, the tension deviation is applied to a speed regulator to control its associated allotted of tension and a tension profile within the furnace. The tension profile is changed by first applying the correction factor to the multiplier coupled to that section essentially affecting the strip and then successively sequentially applying the correction factor to the remaining multipliers.

1 Claim, 4 Drawing Figures

METHOD OF CONTROLLING THE TENSION OF A STRIP WITHIN FURNACE

BACKGROUND OF THE INVENTION

This invention relates to a method of controlling the tension of a strip within a furnace, and more particularly, to such a method of controlling the tension profile of a strip developed within a heating furnace forming a process line including a multitude of carrier rollers for carrying the strip.

A conventional tension control apparatus for carrying out a method of control of the type referred to has comprised a tension controlled strip carried within a furnace by means of multitude of conveying rollers disposed in a plurality of sections into which the furnace is divided. In each section, the conveying rollers are driven by respective electric motors energized by a common electric source connected to a speed regulator. A tension meter is also disposed at an outlet of each section to sense an outlet tension of the strip and to produce an actual outlet tension signal. The actual outlet tension signal is subtracted from a reference tension signal which is output fron a reference tension generator disposed in the associated section. A deviation tension signal corresponding to the difference between the reference tension signal and the actual tension signal is applied to the associated speed regulator along with a common reference speed signal for the conveying rollers.

The speed regulators included in the respective control loops are responsive to the associated deviation tension signals and the reference speed signal applied thereto to change the speeds of the conveying rollers about a reference magnitude thereof so as to vary the tension of the strip carried by the conveying rollers until the actual tension signals sensed by the respective tension meters are respectively equal to the reference tension signals from the associated reference tension generators.

However, conventional tension control apparatus, such as those described above, have been disadvantageous in that: (1) in order to determine a tension profile developed in the respective sections as a whole, it is necessary to manually adjust the reference tension generators separately on all such occasions and only by relying on the rule of trial and error, (2) it is difficult to adjust the reference tension generators because a roller driving system disposed in the furnace does not include pinch rollers or the like and exerts only a weak restraint on the strip and because complicated conditions are imposed on the determination of the reference tension signals, and (3) the strip may be damaged due to slips of the rollers relative to the strip because of the fact that the rate of change in tension profile in the longitudinal direction of the furnace can not be controlled.

Accordingly, it is an object of the present invention to provide a new and improved control method of easily controlling the tension of a strip moved within a furnace without an excessive control force occurring and with a change in tension as a whole maintained so as to be sufficiently small.

SUMMARY OF THE INVENTION

The present invention provides a method of controlling a tension of the strip within a furnace forming a process line which is divided into a plurality of sections, comprising the steps of comparing the tension allotted to each of the sections with the actual tension sensed in a corresponding one of the sections to form a tension deviation for each of the sections, comparing a reference tension profile developed within the entire furnace with an actual tension profile sensed by the tension sensors to determine a correction factor in accordance with the difference between the reference tension profile and the actual tension profile, correcting the tension deviation in accordance with the difference between the reference tension profile and the actual tension profile, correcting the tension deviation in accordance with the correction factor, and controlling both the tension allotted to each of the sections and the tension profile developed on the process line with the corrected deviation tension while, upon varying the once determined profile, successively changing, the tension allotments of the respective sections starting with the section having an important factor determined for the furnace.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENT

Figure 1:
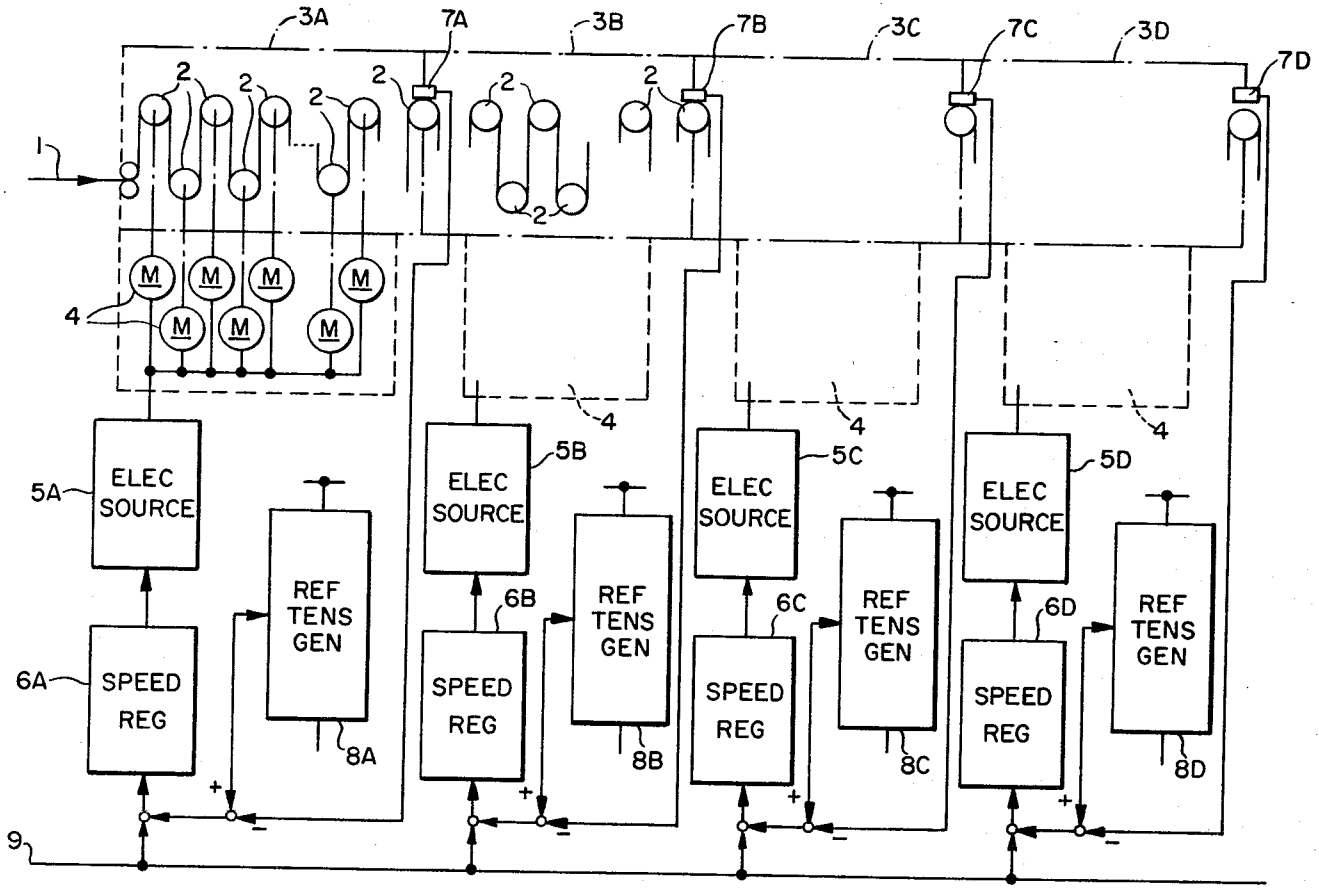
FIG. 1. (PRIOR ART)
FIG. 1 is a block diagram of a conventional control apparatus for controlling a tension of a strip within a furnace.

Referring now to FIG. 1 of the drawings, there is illustrating a conventional control apparatus for controlling the tension of a strip moved within a furnace. The illustrated arrangement comprises a web 1 to be heated (which is hereinafter called a "strip") supported in its tensioned stated within a heating furnace by a multitude of conveying rollers 2 disposed alternately in a pair of upper and lower arrays and in a plurality of sections into which the furnace is divided. In the illustrated example, the furnace is divided into four sections 3A, 3B, 3C and 3D. In each section, the conveying rollers 2 are driven by their own driving electric motors 4 subsequently energized together by a single electric source 5A, 5B, 5C or 5D. Each of the electric sources 5A, 5B, 5C or 5D is connected to a speed regulator 6A, 6B, 6C or 6D for controlling the speed of the electric motors 4 disposed in associated section 3A, 3B, 3C or 3D.

In the arrangement of FIG. 1, it is assumed that the conveying rollers 2 are rotated to carry the strip 1 from the left to the right of FIG. 1 or in the order of the sections 3A, 3B, 3C and 3D and along a zigzag path as determined by those rollers.

A plurality of tension sensors or tension meters, in the illustrated example, four tension meters 7A, 7B, 7C and 7D are disposed at the outlets of the sections 3A, 3B, 3C and 3D so as to sense the outlet tensions of those portions of the strip 1 reaching the conveying rollers 2 located at the outlets of the sections in the upper array to respectively produce the actual outlet tension signals. A plurality of reference tension generators 8A, 8B, 8C and 8D, one generator for each section, are disposed so as to be operatively coupled to the associated tension meters 7A, 7B, 7C and 7D to thereby subtract the actual outlet tension signals from the reference tension signals generated so as to thereby respectively produce the deviation tension signals.

Those deviation tension signals are combined with a common reference speed signal for the conveying rollers 2 develped on a lead 9 to form control signals, one for each section. Then, each of the control signals are applied, as a feedback signal, to the associated speed regulator 6A, 6B, 6C or 6D. Thus, the sections 3A, 3B, 3C and 3D are separately controlled by closed control loops respectively formed therein and as a whole, the arrangement forms a heating furnace providing a process line.

The speed regulators 6A, 6B, 6C and 6D are operated to change the speeds of the conveying rollers 2 about a reference magnitude thereof in response to the associated control signals respectively applied thereto so as to vary the tension of the strip 1 carried by the conveying rollers 2 within the furnace. Ultimately, the actual tension signals sensed by the tension meters 7A, 7B, 7C and 7D are respectively identical to the reference tension signals from the associated reference tension generators 8A, 8B, 8C and 8D.

From the foregoing, it is seen that the closed control loops respectively independently control the tension of the strip 1 in the associated sections 3A, 3B, 3C and 3D.

It is noted that in FIG. 1, the components disposed in each of the sections 3B, 3C or 3D are partly or fully omitted except for the electric source, speed regulator, tension meter and reference tension generator only for purposes of illustration.

Conventional tension control apparatus such as that described above have been disadvantageous in the following respects:

(1) In order to determine a tension profile in the sections 3A, 3B, 3C and 3D as a whole, it is necessary to manually adjust the reference tension generators 8A, 8B, 8C and 8D separately on all such occasions. Since each of the control loops is independent of the other control loops, an interference occurs between each pair of adjacent control loops. Therefore, the tension profile can not to be unequivocally determined and there is nothing to do but to adjust the reference tension generators according to the rule of trial and error.

(2) A roller driving system disposed within the furnace does not include pinch rollers or the like and can only apply a weak restraint to the strip 1. In a construction including a plurality of independent control loops which are consecutive to one another, each of the control loops is only permitted to exert a limited control force on the strip 1 and the complicated conditions are imposed upon the reference tension signals which are respectively operated per se by the reference tension generators 8A, 8B, 8C and 8D. This has resulted in a difficult adjustment.

(3) Since the roller driving system within the furnace is weak in restraint, as described in Item (2), a rate of change in the tension profile in the longitudinal direction of the furnace is preferably controlled to a constant magnitude or less. This, however, has been impossible to control by conventional control methods. In addition, excessive control forces have been applied to the rollers and the strip may be damaged due to slips of the rollers relative to the strip.

The present invention contemplates the elimination of the disadvantages of the prior art practice, as described above, by the provision of a tension control method for controlling the tension of a strip carried within a heating furnace by means of a multitude of conveying rollers divided into a plurality of sections, the control effected in response to both the tension allotted to each section and the tension profile developed for the entire furnace. The tension control method of the present invention can be carried out by a tension control apparatus facilitating an easy adjustment of the tension as compared with the prior art apparatus and preventing an excessive control force from occurring in each section. Furthermore, the entire tension profile is changed by varying tension profiles in the respective sections in a sequence determined for the furnace. This measure results in the control of the tension with the total change in tension being kept sufficiently small.

Figure 2:
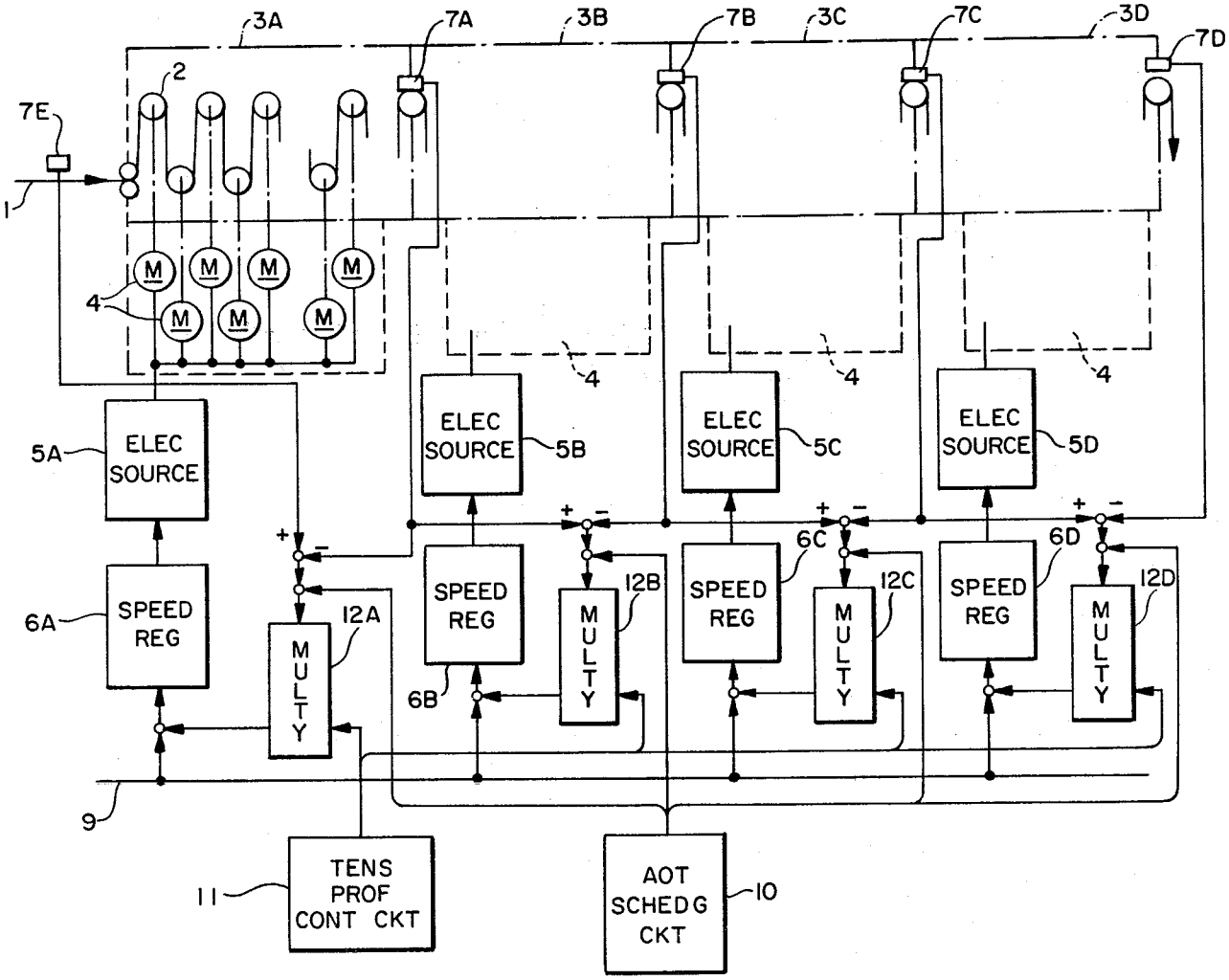
FIG. 2 is a block diagram of a tension control apparatus for carrying out one embodiment according to the tension control method of the present invention.

Referring now to FIG. 2, wherein like reference numerals designate the components identical to those shown in FIG. 1, there is illustrated a tension control apparatus for carrying out one embodiment according to the tension control method of the present invention. In the illustrated arrangement, an inlet tension meter 7E is disposed at the inlet of the furnace (not shown) or at the inlet of the first section 3A to sense an inlet tension of the strip 1 for the first section 3A to produce an actual inlet tension signal therefor. The actual tension signal sensed by each of the tension meters 7A, 7B and 7C is utilized as the actual outlet tension for the associated section and the actual inlet tension for the next succeeding section.

The arrangement further comprises an allotment-of-tension scheduling circuit 10 and a tension profile control circuit 11. The allotment-of-tension scheduling circuit 10 calculates the sets the tension alotted to each of the sections 3A, 3B, 3C or 3D from a reference tension profile according to which the arrangement of FIG. 2 controls the tension of the strip 1. The term "the tension allotted to each section" implies the slope of a line passing through an inlet and an outlet tension in each section. The circuit 10 provides the allotted tension thus set for each section. On the other hand, the tension profile control circuit 11 has stored therein the reference tension profile or a reference inlet tension and a reference outlet tension of each section and also has the actual inlet and outlet tensions sensed by the tension meters 7E, 7A, 7B, 7C and 7D respectively successively applied thereto. The application of the actual sensed tension signals are not shown in FIG. 2 merely for the purpose of simplifying the illustration. Therefore one can determine the deviations of the actual inlet and outlet tensions sensed by the associated tension meters from the reference inlet and outlet tensions stored therein for each section. The circuit 11 delivers a correction factor to multipliers 12A, 12B, 12C and 12D, one multiplier for each section, each correction factor being in response to the magnitude of its associated deviation.

As shown in FIG. 2, the actual outlet tension signal sensed at the outlet of each section is subtracted from the associated actual inlet tension signal to form a difference tension signal therebetween. In each section, the difference tension signal is compared with a signal for the corresponding allotment of tension from the allotment-of-tension scheduling circuit 10 to form a deviation tension signal which is, in turn, applied to an associated multiplier. In each of the multipliers 12A, 12B, 12C or 12D, the deviation tension signal is multiplied by the correction factor applied thereto from the tension profile control circuit 11. Thus, the correction factor serves as a correction gain by which the deviation tension signal is amplified. The amplified deviation tension signal is applied, as a control signal, to the associated one of the speed regulators 6A, 6B, 6C or 6D.

Accordingly, the tension of the strip 1 is controlled by correcting the speed of the conveying rollers 2 by the tension allotted to the respective sections in accordance with the correction factor or gain which is respectively applied to the multipliers 12A, 12B, 12C and 12D.

It is to be noted that, upon changing the tension profile developed in the entire furnace, the correction factor from the tension profile control circuit 11 is successively applied to the associated multipliers 12A, 12B, 12C and 12D in a sequence which has been predetermined for the particular furnace and which has been stored in the tension profile control circuit 11; but the correction factor is not simultaneously applied to the multipliers. More specifically, the sequence starts with the multiplier operatively coupled to that section having an important factor affecting the strip and then the remaining multipliers receive the correction factor one after another.

The present invention will be, in more detail, described below with reference to the arrangement of FIG. 2 for carrying out the same on the assumption that the arrangement controls the tension of the strip 1 in accordance with a reference tension profile. Such a reference tension profile is shown, by way of example, in FIG. 3 wherein the axis of the abscissa represents positions of the tension meters 7E, 7A, 7B, 7C and 7D and the axis of the ordinate represents a reference tension. Each of the tension meters 7E, 7A, 7B, 7C or 7D has its position designated by a like reference numeral and character identifying that tension meter and one section is defined by each pair of adjacent positions of the tension meters. For example, the section 3B is defined by a pair of adjacent positions 7A and 7B. A broken line is then drawn to pass successively through reference tensions $T_1$, $T_2$, $T_3$, $T_4$ and $T_5$ at the positions 7E, 7A, 7B, 7C and 7D, thereby resulting in the reference tension profile.

On the other hand, the allotment-of-tension scheduling circuit 11 is arranged to set a slope of a line connecting a pair of adjacent tension to each other for each section. The tension of the strip is then controlled so that the actual tension profile has the slopes thus set by the circuit 11.

The description will now be described in conjunction with the determination of the reference tension profile and the control of an actual tension profile.

(1) Determination of Allotment of Tension

As described above, the allotment-of-tension scheduling circuit 11 determines the tension allotted in each section or a slope of a line connecting the reference inlet and outlet tensions for each section. While this determination may be made at will, it is assumed that an inlet tension $T_E$ is supplied for an associated furnace or the first section, an outlet tension $T_D$ is supplied for the furnace or the last section and a minimum tension $T_{MIN}$ within the latter is also supplied.

Figure 3:
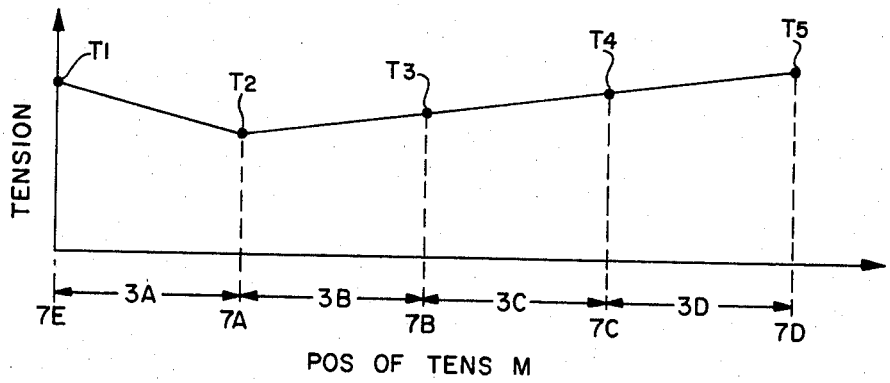
FIG. 3 is a graph illustrating a reference tension profile according to which the arrangment shown in FIG. 2 controls a tension of the strip shown in FIG. 2.
Figure 4:
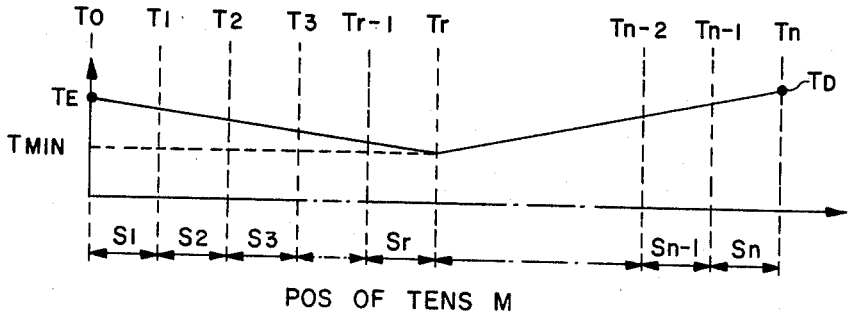
FIG. 4 is a graph similar to FIG. 3 but illustrating a reference tension profile expanded to m sections into which a furnace is divided.

While FIG. 3 shows the four sections 3A, 3B, 3C and 3D and the five tension meters 7E, 7A, 7B, 7C and 7D, it is to be understood that the present invention is equally applicable to any desired number of sections and tension meters whose number is greater by one than that of the sections. In FIG. 4, wherein the axes of abscissa and ordinate have the same meaning as those shown in FIG. 3, there are illustrated m sections $S_1$, $S_2$, . . . , $S_r$, . . . , $S_m$ and (m+1) positions of the tension meters with the inlet tension $T_E$, the outlet tension $T_D$ and the minimum tension $T_{MIN}$ described above. The r-th section has an inlet tension $T_{r-1}$ and an outlet tension $T_r$.

In order to determine a reference tension profile having the minimum tension $T_{MIN}$ equal to the outlet tension $T_r$ of the r-th section $S_r$ as shown in FIG. 4, an allotment of tension $\alpha_1$ is given between the first section $S_1$ and the r-th section $S_r$, the tension $\alpha_1$ being expressed by $$\alpha_1=(T_{MIN}-T_E)/r \tag{1}$$

and an allotment of tension $\alpha_2$ is given between the (r+1)-th section $S_{r+1}$ and the m-th section, the tension $\alpha_2$ being expressed by $$\alpha_2=(T_D-T_{MIN})/(m-r) \tag{2}$$

In other words, a line passing through the inlet tension $T_E$ of the first section $S_1$ and the outlet tension $T_r$ of the r-th section $S_r$ has a slope of $\alpha_1$ as defined by the expression (1) and a line passing through the inlet tension $T_r$ of the (t+1)-th section $S_{r+1}$ and the outlet tension $T_m$ or $T_D$ of the last or m-th section $S_m$ has a slope of $\alpha_2$ as determined by the expression (2). The allotment of tension or slope $\alpha_1$ or $\alpha_2$ as thus determined is then provided to each section.

(2) Control of Tension Profile

As described above, the tension profile control circuit 11 controls the tension profile. It is recalled that the tension profile control circuit 11 has stored therein a reference tension profile, in this case, that shown in FIG. 4. The reference tension stored in the circuit 11 is designated by the reference character identifying the actual tension corresponding thereto and suffixed with x. For example, $T_{rx}$ designates a stored tension corresponding to the actual tension $T_r$.

The control steps will now be described.

(i) The actual tension $T_r$ is compared with the stored tension $T_{rx}$ in the r-th section $S_r$ where r=1, 2, 3, 4 in FIG. 3 or where r=1, 2, . . . , m in FIG. 4. That is, this comparison is repeated with the four sections 3A, 3B, 3C and 3D in FIG. 3 or with the m sections $S_1$, $S_2$, . . . , $S_m$ in FIG. 4.

(ii) When the results of the comparisons indicate that $|T_r-T_{rx}|=\Delta T_r$ exceeds a specified magnitude in at least one of the sections, the correction factor or gain g is calculated by the following equation $$g=\sqrt{\sum_{r=1}^{m}\delta_r(T_{rx}-T_r)^2} \tag{3}$$

where $\delta_r$ designates a weight coefficient for the r-th section. It will readily be understood that m has a value of four in FIG. 3. By properly selecting the weight coefficient $\delta_r$, that section having the preference can be determined with respect to the entire tension profile.

(iii) In all the sections, the slope of the actual tension ($T_r - T_{r-1}$) is successively compared with that of the stored tension ($T_{rx} - T_{(r-1)x}$). If $$|T_{rx} - T_{(r-1)x}| > |T_r - T_{r-1}| \quad (4)$$

as determined by this comparison, then the allotment of tension $\alpha_1$ or $\alpha_2$ as defined by the expression (1) or (2) is increased in proportion to the correction gain g as defined by the expression (3) in each of the multipliers 12A, 12B, 12C or 12D.

On the contrary, if $$|T_{rx} - T_{(r-1)x}| < |T_r - T_{r-1}| \quad (5)$$

as determined by the comparison, then the allotment of tension $\alpha_1$ or $\alpha_2$ is decreased in proportion to the reciprocal of g in each of the multipliers 12A, 12B, 12C or 12D.

(iv) Variation in Tension Profile

The tension profile is varied by changing the manner in which the correction factor or gain from the tension profile control circuit 11 is applied to the multipliers 12A, 12B, 12C and 12D, as required. It is to be noted that the application of the correction gain to those multipliers is accomplished in the sequence as described above, but is not applied simultaneously. This measure can minimize the total change in tension of the strip 1.

From the foregoing it is seen that, according to the present invention, the tension profile within the entire furnace is controlled in response to a supervised tension profile while at the same time the tension allotted in each of the sections is controlled so as to be within a predetermined constant range. Therefore, the tension can be controlled to any tension profile as required without the complicated adjustment effected in each of the sections. Control outputs from the respective sections are also separately controlled with the result that the strip is prevented from being damaged due to slips of the rollers relative to the strip. Furthermore, the furnace is only permitted to cause a minimum change in tension because the tension profile is varied by applying the correction factor to the multipliers from the tension profile control circuit in a predetermined sequence, but the correction factor is not applied to all the multipliers at the same time.

While the present invention has been illustrated and described in conjunction with a single preferred embodiment thereof, it is to be understood that numerous changes and modifications may be resorted without departing from the spirit and scope of the present invention. For example, while the allotment of tension has been determined with given tension $T_E$, $T_D$ and $T_{MIN}$, it is to be understood that the present invention is not limited thereto and that any calculations other than those described above may be effected as long as the allotment of tension can be determined. Alternatively, the allotment of tension may be directly determined for each of the sections. While the correction factor or gain for the tension profile has been defined by the expression (3), it is to be understood that any expression or a function may be used, provided that the difference tension $T_{rx}$ $T_r$ is equally reflected in the sections $S_1$, $S_2$, . . . , $S_r$. Furthermore, an abrupt change in tension of a strip is not generally desirable, and therefore, the control steps (i), (ii) and (iii) may be executed through the sampling control with a sampling time.

What we claim is:

1. A method of controlling the tension of a strip within a furnace forming a process line which is divided into a plurality of sections, the method comprising the steps of comparing a predetermined tension which has been allotted to each of said sections with an actual tension which has been sensed in a corresponding one of said sections so as to form a tension deviation for each of said sections, comparing a predetermined reference tension profile which has been developed for the entire furnace with an actual tension profile which has been sensed by tension sensors in said furnace so as to determine a correction factor corresponding to the difference between said reference tension profile and said actual sensed tension profile, correcting said tension deviation in accordance with said correction factor, and controlling both said tension allotted to each of said sections and said tension profile developed for said process line with said corrected tension deviation and, upon varying the so determined tension profile, successively and sequentially changing said tension allotted to said respective sections, starting with a predetermined section of the furnace.

* * * * *